US007477148B2

(12) United States Patent
Lynn et al.

(10) Patent No.: US 7,477,148 B2
(45) Date of Patent: Jan. 13, 2009

(54) SOAP DISPENSER AND METHOD FOR ASSURING CLEAN HANDS

(75) Inventors: John M. Lynn, Round Rock, TX (US); Kathryn Anne Newth, Round Rock, TX (US)

(73) Assignee: Airborne Health, Inc, Bonita Springs, FL (US)

( * ) Notice: Subject to any disclaimer, the term of this patent is extended or adjusted under 35 U.S.C. 154(b) by 57 days.

(21) Appl. No.: 11/426,216

(22) Filed: Jun. 23, 2006

(65) Prior Publication Data

US 2006/0231568 A1 Oct. 19, 2006

Related U.S. Application Data

(63) Continuation of application No. PCT/US2005/018981, filed on May 31, 2005.

(60) Provisional application No. 60/634,211, filed on Dec. 8, 2004, provisional application No. 60/630,361, filed on Nov. 22, 2004, provisional application No. 60/583,451, filed on Jun. 28, 2004, provisional application No. 60/575,910, filed on Jun. 1, 2004.

(51) Int. Cl.
*G08B 21/00* (2006.01)

(52) U.S. Cl. ..... 340/540; 340/573.1

(58) Field of Classification Search ..... 340/573.1, 340/540; 222/92, 175, 638, 644; 434/236, 434/238; 273/445, 446
See application file for complete search history.

(56) References Cited

U.S. PATENT DOCUMENTS

| | | | | |
|---|---|---|---|---|
| 4,431,628 | A * | 2/1984 | Gaffar | 424/9.71 |
| 4,992,256 | A * | 2/1991 | Skaggs et al. | 424/9.71 |
| 5,771,925 | A * | 6/1998 | Lewandowski | 137/552.7 |
| 6,029,600 | A | 2/2000 | Davis | 116/200 |
| 6,206,238 | B1 | 3/2001 | Ophardt | 222/1 |
| 6,211,788 | B1 * | 4/2001 | Lynn et al. | 340/573.1 |
| 2002/0082177 | A1 | 6/2002 | Tabaac | 510/130 |
| 2004/0090333 | A1 * | 5/2004 | Wildman et al. | 340/573.1 |

OTHER PUBLICATIONS

Notification Concerning Transmittal of Copy of International Preliminary Report on Patentability for International Application No. PCT/US2005/018981 (10 pages).

* cited by examiner

*Primary Examiner*—George A Bugg
*Assistant Examiner*—Shirley Lu
(74) *Attorney, Agent, or Firm*—Tracy W. Druce; Novak Druce & Quigg LLP

(57) ABSTRACT

A method and apparatus are disclosed for assuring clean hands are disclosed. The method includes marking a hand of a user with an easily identifiable substance that can be washed off with a cleaning composition when a soap dispenser is utilized.

18 Claims, 4 Drawing Sheets

SOAP DISPENSER AND METHOD FOR ASSURING CLEAN HANDS

CROSS REFERENCE TO RELATED APPLICATIONS

This application is a continuation of International Application No. PCT/US2005/018981 filed May 31, 2005 which claims priority from (1) U.S. Provisional Patent Application Ser. No. 60/575,910 filed Jun. 1, 2004 by John Lynn et al., and entitled "Soap Dispenser that Marks Hands to Assure Sanitation;" (2) U.S. Provisional Patent Application Ser. No. 60/583,451 filed Jun. 28, 2004 by John Lynn et al., and entitled "Soap Dispenser and/or Base Product;" (3) U.S. Provisional Patent Application Ser. No. 60/630,361 filed Nov. 22, 2004 by John Lynn, and entitled "Soap Dispenser That Assures Sanitation;" and (4) U.S. Provisional Patent Application Ser. No. 60/634,211 filed Dec. 8, 2004 by John Lynn, and entitled "Soap Dispenser That Assures Sanitation."

TECHNICAL FIELD

The present disclosure relates in general to the field of maintaining sanitation using a soap dispenser, and, more particularly, to doing so by marking a person's hands and providing a signal to help coerce effective handing washing.

BACKGROUND

In a variety of different fields, including businesses and residences, there is a great desire to encourage people to wash their hands more effectively and more frequently. The U.S. Center for Disease Control has stated that the most important thing people can do to keep from getting sick is to wash their hands. And yet, many people, through lack of knowledge, poor habits or simple negligence either do not wash their hands frequently enough or effectively enough.

An example of a specific need for assuring sanitized hands is the food services industry. It has been known for many decades that food preparers, servers and so forth should clean and sanitize their hands prior to handling food to be served. This need is self-evident when food service employees enter restrooms. Bacteria (such as E-coli, those found in fecal matter, uncooked foods, etc.) in restrooms are well known health hazards and without proper cleaning/sanitization of the hands of restaurant employees, can be transmitted to unknowing customers. These and other concerns also suggest a need for sanitizing hands in private residences, especially in homes with children.

Currently, parents as well as health industry participants are trying to address the problem of insufficient hand washing with rules and regulations concerning hand washing. For instance, in many food service establishments there are signs which state roughly "Employees must wash their hands before leaving." Methods that require adherence to a rule or policy by human beings with little or no reinforcement or monitoring, however, are typically insufficient to maximize compliance. Importantly, such rules and regulations do little or nothing to assure that even if hand washing is done, it is done correctly (e.g., with enough cleaning composition, for a long enough period of time to kill the germs, or with sufficient scrubbing). Further, there are a number of different commercial style soap dispensers that have methods of trying to assure frequency of hand washing by things such as electronic counting, identification, monitoring and so forth. However, none of these technologies also attempt to assure efficacy of hand washing in addition to frequency of hand washing. This distinction is important because a person can wash their hands often enough but not well enough. In short, frequency alone is not sufficient to assure effective hand washing.

Presently there are several systems intended to address the problem of insufficient hand washing. These systems are typically very complex and, accordingly, prohibitively expensive. U.S. Pat. No. 5,670,945, for example, discloses a complex system that has a sanitizing basin with moisture proof switches inside the sanitizing basin and proximity detectors. A person must insert both hands simultaneously into the sanitizing basin in order to initiate the desired output signal. Additionally, U.S. Pat. Nos. 6,426,701; 5,945,910; 5,812,059; 5,202,666; 4,896,144; 3,967,478; 5,610,589; 4,688,585 and 5,199,188 and U.S. Patent Application Nos. 2003/0030562; 2003/0197122; 2003/0019536; and 2004/0001009 all involve relatively complex systems containing components such as complex electronics, location sensors, pumps and so forth (often mixed together in complex attempts to require hand washing). In summary, the presently available systems are typically expensive, complex to install, difficult to maintain and it can be difficult to train users in their operation.

U.S. Pat. No. 5,771,925 discloses a soap dispenser that has timing mechanism when the soap dispenser is utilized. The timing mechanism is included in the housing for the soap dispenser such that each time the soap dispenser is replaced, the timing mechanism must also be replaced. Additionally, the timing mechanism only provides an indication of a minimum amount of time that a user should wash his hands but does not provide any mechanism to ensure that the user does wash his hands for the minimum amount of time.

SUMMARY

In accordance with the present disclosure, the disadvantages and problems associated with assuring clean hands have been substantially reduced or eliminated. In a particular embodiment, a hand of a user is marked with an easily identifiable substance during hand washing.

In accordance with one embodiment of the present disclosure, a method for helping to assure washing of a person's hands using a soap dispenser containing a cleaning composition includes marking a hand of a user with an easily identifiable substance that can be washed off with the cleaning composition when the soap dispenser is utilized.

In accordance with another embodiment of the present disclosure, an apparatus for helping to assure washing of a person's hands includes a soap dispenser and a marking mechanism coupled to the soap dispenser. The marking mechanism marks a hand of a user of the soap dispenser in order to encourage better hand washing.

In accordance with a further embodiment of the present disclosure, a method for helping to assure washing of a person's hands using a soap dispenser containing a cleaning composition includes identifying a user of the soap dispenser with an identification mechanism and marking a hand of the user with an easily identifiable substance that can be washed off with the cleaning composition when the soap dispenser is utilized.

BRIEF DESCRIPTION OF THE DRAWINGS

A more complete and thorough understanding of the present disclosure and advantages thereof may be acquired by referring to the following description taken in conjunction with the accompanying drawings, in which like reference numbers indicate like features, and wherein.

DETAILED DESCRIPTION

Preferred embodiments of the present disclosure and their advantages are best understood by references to FIGS. 1 through 6, where like numbers are used to indicate like and corresponding parts.

Figure 1:
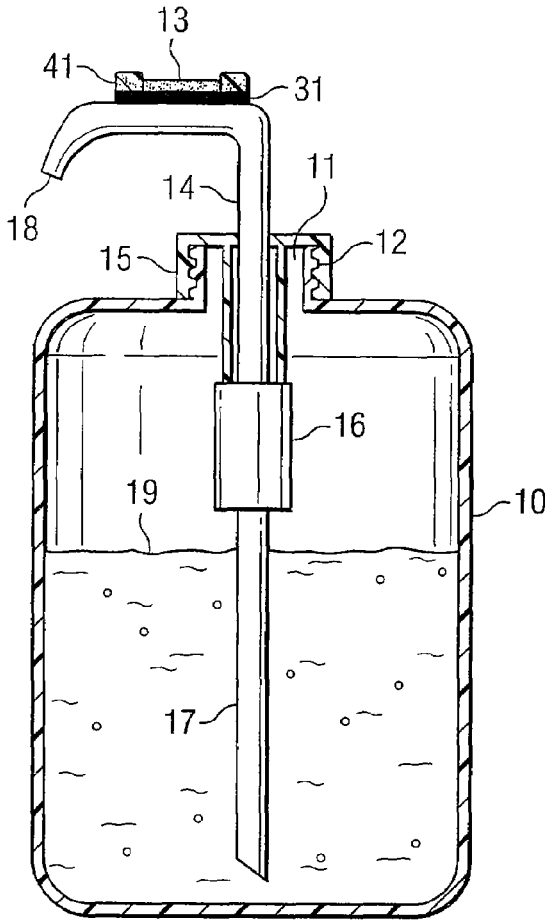
FIG. 1 illustrates a cross-sectional view of one embodiment of a marking soap dispenser according to teachings of the present disclosure.

FIG. 1 is a cross-sectional view of one embodiment of a hand marking soap dispenser. In the embodiment of FIG. 1, the dispenser includes container 10 for cleaning composition 19. Container 10 has opening 11 defined by threaded male lip 12. Male lip 12 is designed to fit female threaded cap 15 so that cap 15 can be taken on and off to allow container 10 to be filled or refilled with cleaning composition 19. In other embodiments, it may also be possible for the dispenser to be designed such that it is disposable after cleaning composition 19 has been depleted and thus there is no need for cap 15.

Container 10 may be designed to sit substantially flat on a surface such as a table, sink or counter. Container 10 may also be configured (not expressly shown) to mount on a wall or other vertical surface. Additionally, the shape of container 10 may be varied. For use with children, container 10 may be made in the shape of an animal or action hero. In this case, if an audible signal is provided, the audible signal of the device may match the shape of the container. For example, if container 10 is shaped in the form of a frog, an audible signal may provide a croaking noise.

Discharge pipe/outlet/hose 14 may be integral to cap 15 such that pipe 14 extends through opening 11. Additionally, discharge pipe 14 may include orifice 18 where cleaning composition 19 exits the dispenser such that cleaning composition 19 is introduced onto a person's hand. In one embodiment, discharge pipe 14 may be movable up and down through cap 15 and may be coupled to pump mechanism 16, which may have a spring mechanism and plunger such as those used in liquid dispensers well known in the art. In other embodiments, pump mechanism 16 may be any suitable type of pump used to force liquids out of a container. In one embodiment, pump mechanism 16 may be a foaming pump that mixes cleaning composition 19 and air before dispensing cleaning composition 19 through orifice 18. An example of this type of pump is RF-17 Palm Foamer manufactured by Rieke Packaging Systems. Pump mechanism 16 may also be coupled to siphon/suction pipe 17. The up and down motion of discharge pipe 14 associated with pump mechanism 16 may cause cleaning composition 19 to be sucked into siphon pipe 17, into pump mechanism 16, through discharge pipe 14 and ultimately out through orifice 18. In other embodiments, any other mechanism may be used to dispense cleaning composition 19 from container 10. For example, cleaning composition 19 may be dispensed onto a person's hands by using any type of suitable electronics that allow for marking a person's hand with an easily identifiable substance to assure effective hand washing. The use of pumping mechanisms to dispense a cleaning composition are known in the art and as such various modifications may be made to the exemplary embodiment discussed here in without departing from the spirit of the teachings of the present disclosure.

Absorbent pad 13 and compressible protective perimeter 41 may cooperate to form a marking mechanism. Absorbent pad 13 may be any of a number of materials (e.g., felt used for markers or a pad used for stamps). One commercially available absorbent pad is felt "Fiber Engineered" manufactured by AFFCO of New Windsor, N.Y. Absorbent pad 13 may include an easily identifiable substance used to mark a hand that comes in contact with absorbent pad 13. Protective perimeter 41 may be shaped compressible foam (or any other suitable compressible material with memory) that surrounds absorbent pad 13 and has a thickness greater than a thickness of absorbent pad 13. If protective perimeter 41 is formed from foam, the foam may be a closed cell foam that will not allow the easily identifiable substance to wick through. Protective perimeter 41 may have any shape such that protective perimeter 41 prevents a user from inadvertently marking clothing, towels and/or other articles that come into contact with the top of discharge pipe 14. However, when a user presses down on the top of discharge pipe 14, the user's hand first comes into contact with protective perimeter 41 which compresses and allows the user's hand to come into contact with absorbent pad 13. A mark, therefore, may be placed on the user's hand used to press down on discharge pipe 14 and cleaning composition 19 may be dispensed onto the user's other hand.

In some embodiments, there may be no automatic mechanism to replenish the supply of the easily identifiable substance. As such, when absorbent pad 13 either runs out of the easily identifiable substance or the easily identifiable substance dries out and no longer marks the hand of a person pushing down on absorbent pad 13, absorbent pad 13 may be removed from discharge pipe 14 such that a new absorbent pad 13 including the easily identifiable substance may be attached to discharge pipe 14 to replace the spent one. In one embodiment, replacement of absorbent pad 13 may be accomplished with the use of attachment mechanism 31 such that the easily identifiable substance may be replenished by removing attachment mechanism 31 and then placing a new one of absorbent pad 13, compressible protective perimeter 41 and/or attachment mechanism 31 on the top surface of discharge pipe 14. Attachment mechanism 31 may include, but is not limited to, double-sided tape, a pressure sensitive adhesive (PSA), non-permanent adhesive glues and/or gels, a Velcro™-like material and any other attachment mechanisms that allow for the marking mechanism to be detachably coupled to the top of discharge pipe 14. In another embodiment, absorbent pad 13 may be kept wet with the easily identifiable substance for a longer period of time by using a reservoir of the easily identifiable substance that is pumped (e.g., a small mechanical pump such as those used to resupply stamp pads) to absorbent pad 13 as the soap dispenser is used.

In disposable soap dispensers it may be desirable to have the cleaning composition run out at roughly the same time as the easily identifiable substance runs out (or vice versa). In the embodiment where the marking mechanism includes an absorbent pad, it may be preferable that absorbent pad 13 starts to run dry as the dispenser runs out of cleaning composition 19. This would allow the user to throw away the entire pre-filled dispenser with the marking mechanism on the top of the pump and buy a new dispenser. In this embodiment, absorbent pad 13, protective perimeter 41, attachment mechanism 31 and discharge pipe 14 may be combined into a single integrated unit that both dispenses cleaning composition 19 and also marks a person's hand as the dispenser is utilized.

Although a specific marking mechanism is illustrated in FIG. 1, the marking mechanism may also be implemented using a variety of technologies and configurations. For example the marking mechanism may include any of the marking mechanism types set forth in U.S. Pat. Nos. 6,031,461 or 6,211,788. The marking mechanisms may include systems, including but not limited to: (1) mechanical, (2) pneumatic, (3) pneumatic (mechanical), (4) electronic, and (5) any combination thereof. Additionally, the marking mechanism may dispense the easily identifiable substance as a spray, micro-dot or mist from separate tubes or nozzles in close proximity to discharge pipe 14. In this example, the easily identifiable substance may be discharged on the user's hand concurrently (or approximately concurrently) with the cleaning composition or the easily identifiable substance may be mixed with cleaning composition 19.

The easily identifiable substance may be a variety of different types of substances such as those substances set forth in the U.S. Pat. Nos. 6,031,461 and 6,211,788. These substances may include inks, dyes, vegetable dyes, paint, stain, pigment, grease and any combination thereof. The easily identifiable substance may also be designed such that it is not easily identifiable visually, but instead is easily identifiable using other detection mechanisms such UV light, or using small metallic substances that are electronically detectable. The easily identifiable substance could further be additional substances such as extremely tiny integrated circuits (sometimes referred to as "smart dust").

The easily identifiable substance may be selected or designed such that the desired type of hand washing is necessitated, once the substance is applied on a hand. For example, the easily identifiable substance may be designed such that it can only be removed by washing it off with cleaning composition 19 (e.g., a liquid soap or a alcohol based composition) and hot or warm water for a sufficient period of time, thereby maximizing sanitation of a person's hands. One example of an easily identifiable substance may be found in "Care Bears Lite Up Stampers" manufactured by Rose Art, Inc. In a cleansing experiment, the easily identifiable substance applied with the Care Bear stamp came off very slowly (over a minute) with water only, but came off in approximately fifteen (15) to twenty (20) seconds with soap and warm water.

Other easily identifiable substances include an aqueous ink which is Food, Drug and Cosmetic approved. One such commercially available ink is a turquoise I-7054 ink 203-52 manufactured by Ranger Ink. Additional commercially available inks or dyes are blue dyes such as 1-methyamino-4-o-tolylaminanthanquinone (Blue No. 403, Sudan Blue B), and violet dyes such as 1-hydroxy-4-p-toluinoanthraquinone (Violet No. 201, Arizroll Purple SS). In a highly sanitary area such as a hospital, nursing home or doctors office, the easily identifiable substance may be designed such that the easily identifiable substance may be removed by a highly effective anti-germ or anti-bacterial cleaning composition (e.g., an alcohol based cleanser such as Purell manufactured by GOJO).

Because of the short time between marking the hand and washing the hand staining or smearing of clothes is not normally an issue. Nevertheless, it can be minimized, if desired, by placement of the easily identifiable substance on an area of the hand which is unlikely to come into contact with other items. For example the mark may be placed in between the fingers on the web of the hand, on the palm of the hand or on the back of the hand. Placement of the mark on a particular part of the hand can be accomplished by use of, for example, finger guides and/or triggers that guide the hand to a desired position prior to marking. In addition, the marking mechanism may be designed such that the easily identifiable substance is applied to the hand in a very thin layer (e.g., as accomplished with stamping mechanisms), thereby maximizing speed of drying and minimizing smearing or staining.

Another manner in which to minimize smearing or staining (or to make smearing or staining less of a problem should it occur) is to formulate the easily identifiable substance such that it includes a composition which is easily removable from clothes and other items. An example of an easily identifiable substance that is described in U.S. Pat. No. 5,043,013 issued to Kluger et al. and entitled "Washable Ink Compositions." U.S. Pat. No. 6,147,607 also sets forth various substances which are more easily washable than typical inks, dyes or pigments.

In order to prevent persons from attempting to bypass the marking mechanism by using a paper towel, toilet tissue or a cloth as a barrier between their hand and the marking mechanism, the marking mechanism may use, for example, techniques like those disclosed in U.S. Pat. No. 6,147,607. These techniques include finger guides that require the marking to be done by the web of the finger (making covering the marked area with paper or cloth problematic) or use of a rough surface (e.g., Velcro™-like) on the marking mechanism that will retain fibers or threads from the barrier used, thus making an attempt to bypass the marking mechanism obvious. This application would be especially useful in residences where a limited number of people use the marking mechanism of the soap dispenser and attempts to bypass it may be easier to trace to a particular person.

Figure 2:
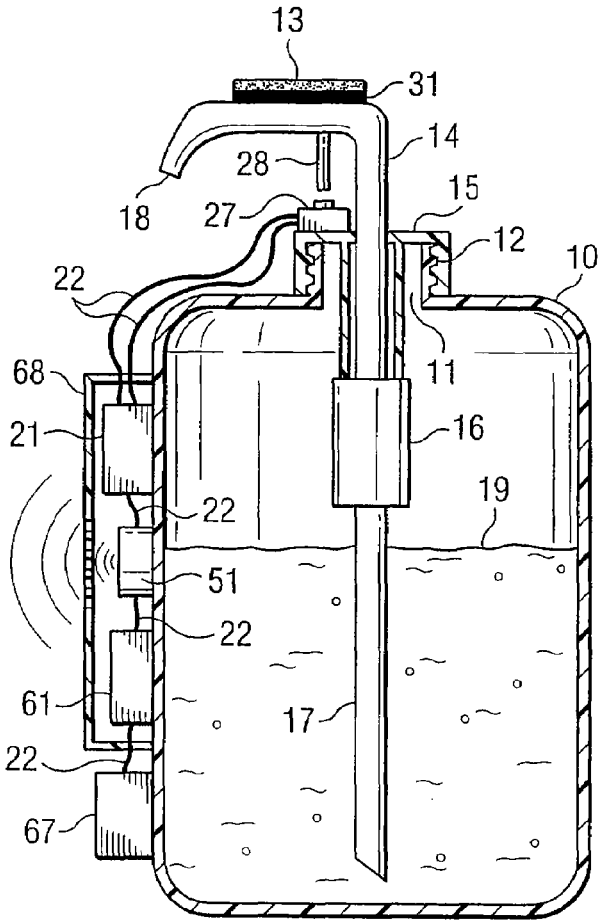
FIG. 2 illustrates a cross-sectional view of another exemplary embodiment of a marking soap dispenser that includes a signal mechanism according to teachings of the present disclosure.

FIG. 2 is a cross-sectional view of another embodiment of a hand marking soap dispenser that includes a signal and/or recording mechanism. The marking mechanism attached to the top of discharge pipe 14 may function similar to the marking mechanism described with respect to FIG. 1. The illustrated marking mechanism, however, may include absorbent pad 13 that covers the top surface of discharge pipe 14 and does not include a protective perimeter. Signal mechanism 51 and recording mechanism 61 may be activated/triggered when discharge pipe 14 is depressed to dispense cleaning composition 19 such that a person's hand is marked substantially simultaneously with the easily identifiable substance from absorbent pad 13. Although only one configuration is illustrated, the soap dispenser may be configured in a variety of ways depending on the desires of the end user. For example it could be configured as follows: (1) a signal mechanism is included but no recording mechanism is included to reduce the cost of the soap dispenser; (2) a recording mechanism is included but no signal mechanism; and (3) both the signal mechanism and recording mechanism are included but either or both may be deactivated or activated as desired by the end user using on/off buttons or switches.

In the illustrated embodiment, signal mechanism 51, recording mechanism 61 and power supply 21 may be associated with container 10. Cover 68 may be coupled with or integral to container 10 to protect signal mechanism 51, recording mechanism 61 and power supply 21. Switch 27 that allows power to flow from power supply 21 to signal mechanism 51 and recording mechanism 61 may be associated with container 10. Switch 27 may be implemented using a variety of technologies including, but not limited to, contact switches, micro-electro-mechanical switches, pushbutton, toggle, slide, and any other suitable types switches. Accordingly, switch 27 may selectively couple signal mechanism 51 and recording mechanism 61 to power supply 21 via one or more wires 22 or other electrical conduits. In the exemplary mode described herein, switch 27 may be activated by trigger 28 that is coupled with (or integral to) discharge pipe 14. As discharge pipe 14 is depressed to dispense cleaning composition 19, trigger 28 may contact switch 27 and activate signal mechanism 51 and/or recording mechanism 61. Signal mechanism 51 and recording mechanism 61, therefore, may be activated when switch 27 is activated.

Similar to existing soap dispensers, the normal unbiased position of discharge pipe 14 is up (due to springs inside pump mechanism 16). Accordingly, trigger 28 may not be maintained in contact with switch 27 when discharge pipe 14 is in the up position such that signal mechanism 51 and recording mechanism 61 are not activated (e.g., no sound or signal is produced by signal mechanism 51 and no activity is recorded by recording mechanism 61). The use of switches, power supplies and signal mechanisms capable of generating sounds are known in the art and as such various modifications may be made to the exemplary embodiment discussed here in without departing from the spirit of the teachings of the present disclosure.

In the illustrated embodiment, the marking mechanism operates as a mechanical trigger that activates signal mechanism 51 and/or recording mechanism 61 and also marks the hand of the person pushing down on the absorbent pad 13 containing the easily identifiable substance. Once the easily identifiable substance is placed on a person's hand, it is likely the person will wash his hand to remove the mark. Removing the mark from the one marked hand will typically require the use of the other unmarked hand. The result is two clean hands.

In one embodiment, signal mechanism 51 may generate a signal that provides information about the desired duration of hand washing. For example, the signal may indicate a minimum period of time that hand washing should occur. The signal may be audible, visual, olfactory, tactile, kinetic or any other suitable type of signal that notifies the user of the soap dispenser of the minimum amount of time needed to wash off the easily identifiable substance. In one embodiment, signal mechanism 51 may include a piezo driven by a processor to generate the desired sound. In other embodiments, signal mechanism 51 may be any electronic or mechanical components that provide the desired signal. The signal may be activated for approximately fifteen (15) to thirty (30) seconds in order to assure good hand washing to kill germs on the hands. The user, therefore, has two entirely different prompts (e.g., the marking mechanism and signal mechanism) that will help assure some minimum period of hand washing. In another embodiment, timing information may be provided separate from signal mechanism 51 as opposed to being integrated into signal mechanism 51.

In the exemplary embodiment where a signal is used to coerce use of the marking soap dispenser, people may become accustomed to hearing and/or seeing the signal. As users develop their routine, failure to use the marking soap dispenser and activate signal mechanism 51 becomes obvious to both the intended user and others who expect to hear or see the signal while the employee is in the restroom. The signal or lack thereof, may begin to have a Pavlovian response. Accordingly, the signal may transform an essentially voluntary action into an almost reflexive action. As a result, use of the marking soap dispenser and accompanying signal may serve as a sign of cleanliness and hygiene and will comfort others interested in hand washing (e.g. restaurant customers, hospital patients and parents of children).

In addition to the Pavlovian effect (e.g., the signal acts as a reminder to the user to wash her hands), signal mechanism 51 may also serve as a positive reinforcement. It is possible that children in households would be praised each time they activate the signal when marking their hands with the soap dispenser. For example, the signal could be selected from a menu including a series of different songs, beeps, tones, directions or noises. The soap dispenser may be placed near a bathroom sink such that the marking mechanism becomes a game for children that teaches them how to wash their hands correctly for the necessary amount of time and with the proper amount of cleaning composition 19 (e.g., the easily identifiable substance will not come off with insufficient hand washing, insufficient cleanser and/or insufficient scrubbing).

In another embodiment, signal mechanism 51 may be designed to make a failure to use the subject soap dispenser obvious. For example, the signal may be a light/button (e.g., an LED) and/or audible signal designed to remain on for some period of time after the soap dispenser has been used. Preferably this delayed signal may be designed to come on or remain on for some period of time longer than the average user is expected to remain in the area (e.g., approximately one to five minutes after use of the dispenser and/or base). Therefore, a person entering shortly after the user has left the dispenser area may expect to see or hear the delayed signal. If the signal is designed to stay on for a predetermined period of time, required users of the soap dispenser may not be able to easily bypass the dispenser because the lack of the signal will be obvious to someone entering the area with the dispenser for the predetermined period of time after the desired user has left the area.

In one embodiment, display window 67 may be included to display information recorded by recording mechanism 61. Display window 67 may be located on the exterior of container 10 and may be maintained in communication with recording mechanism 61 through wires 22. In another embodiment, display window 67 may also be simplified, to lower the cost, to be a light display (e.g., LED) that signals use of the dispenser as described above. Information collected by recording mechanism 61 and displayed by display window 67 may include, but is not limited to, how many times the apparatus was activated during a particular period of time, the times of the activation, and frequency of use of the marking soap dispenser, as well as other characteristics associated with the use of the soap dispenser. In this manner, for example, a parent could, at the end of a day, check how often a child had used the marking soap dispenser and the timing of its use. Recording mechanism 61 could be used to see trends in hand washing, reward positive behavior and attempt to change insufficient hand washing. This information may allow a parent (or employer) to monitor hand washing protocol. Even better, because the mark is designed to require a specific type of hand washing (e.g., hot water and soap for a minimum of fifteen to thirty seconds), recording mechanism 61 essentially not only monitors frequency of hand washing but also an effectiveness of hand washing because the mark only comes off with a minimum period and efficacy (e.g., sufficient scrubbing, energy or vigor) of hand washing.

Recording mechanism 61 may be implemented using a variety of different technologies, including without limitation, one or more of the following: IC, ASIC, EEPROM, FPGA, memory and processor combinations, and/or mechanical counters. With integrated circuits getting cheaper as Moore's Law drives down semiconductor costs, it is possible that a variety of different types of information may be inexpensively collected, stored and displayed. In fact in a business scenario with many users of the disclosure, it may be desirable to track the actions of specific employees and their use of the marking mechanism by having the employees wear electronic badges (e.g., RFID devices) or using biometrics that allow recording mechanism 61 to differentiate the actions of different persons using the soap dispenser.

In another embodiment (not expressly shown), signal mechanism 51 and/or recording mechanism 61 may be located remotely from the marking mechanism. This configuration may be desirable where a person monitoring hand washing (e.g., restaurant manager or parent of a young child) desires to have the signal and/or recorded information presented at a location other than where the soap dispenser is placed. For example, a parent may not be able to detect the signal from the dispenser if it goes off only in the child's bathroom area. If the signal is audible, signal mechanism 51 may have a local or remote volume control so that parents (or employers) can change the volume on the signal to their needs. For example, a parent may place one or more remote signal mechanisms in another area of the house such as the kitchen or living room. The remote mechanism may be implemented by hardwiring signal mechanism 51 to a remote location or using one or more wireless technologies. In general, remote communication my be facilitated by placing one or more transmitters/transceivers in communication with one or more receivers/transceivers. Examples of wireless technology capable of communicating in accordance with the teachings of the present disclosure include without limitation, IEEE 802.11x technologies, Bluetooth, GSM (Global system for mobile communications) 3βSM, CDMA, TDMA, infrared, radio spectrum, as well as others.

Figure 3:
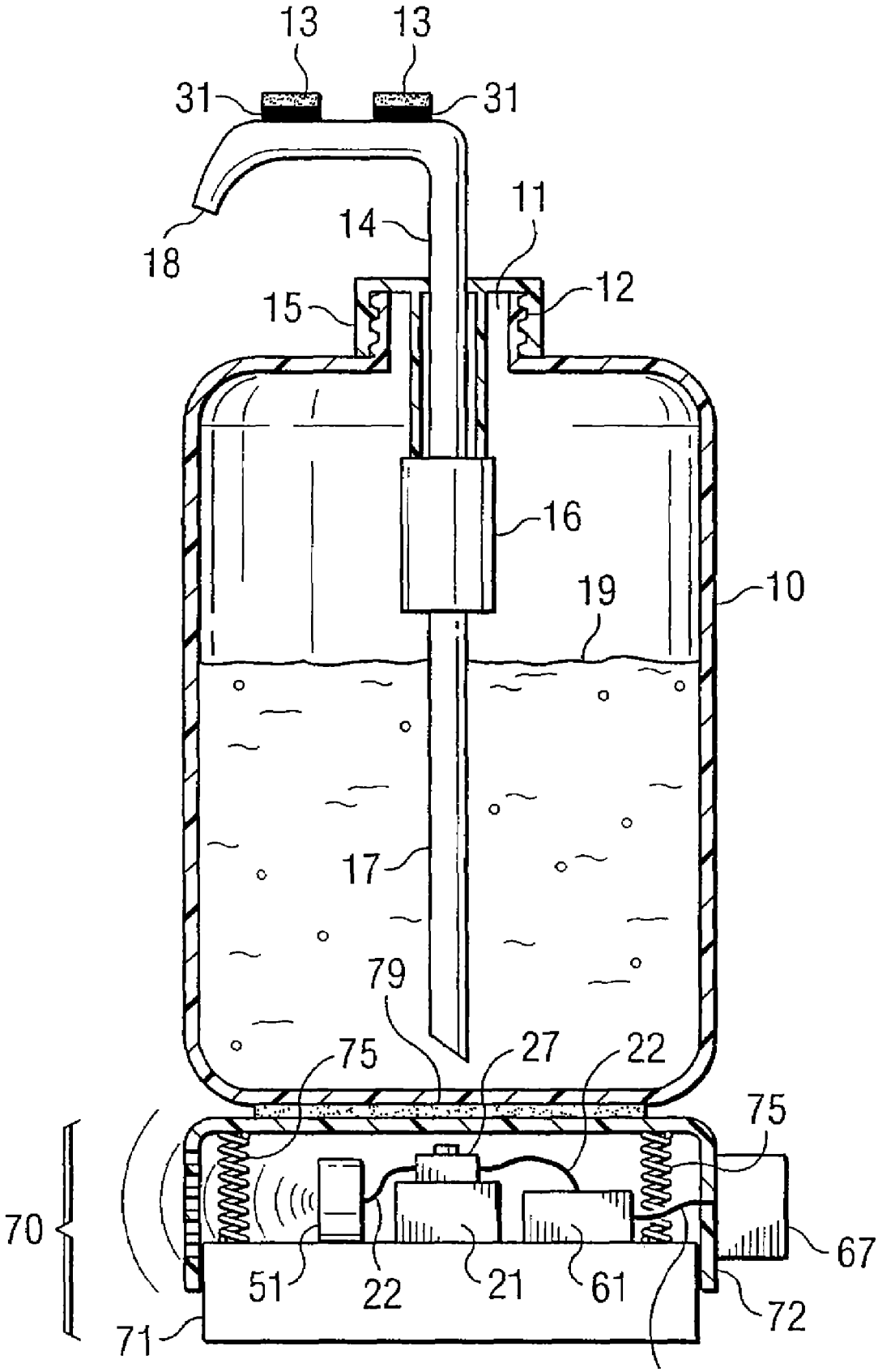
FIG. 3 illustrates a cross-sectional view of a further exemplary embodiment of a marking soap dispenser that includes a detachable base having a signal mechanism according to teachings of the present disclosure.

FIG. 3 is a cross-sectional view of a further embodiment of a hand marking soap dispenser that includes a base having a signal and/or recording mechanism. The marking mechanism attached to the top of discharge pipe 14 may function similar to the marking mechanisms described with respect to FIGS. 1 and 2. The marking mechanism illustrated, however, may include multiple absorbent pads 13 on the area where discharge pipe 14 is pressed because in some cases where absorbent pads 13 are small and the area where the hand depresses discharge pipe 14 is relatively large, it may require more than one absorbent pad 13 to assure that a person's hand is marked when she presses down on the soap dispenser.

Similar to the dispenser illustrated in FIG. 2, signal mechanism 51 and recording mechanism 61 may be associated with the dispenser. In the embodiment illustrated in FIG. 3, signal mechanism 51 and recording mechanism 61 may be included in base/bottom 70 of the soap dispenser. In some embodiments, base 70 may be detachably attached to container 10 so that base 70 may be used with other soap dispensers. Further, a detachable base may allow the detached/remaining soap dispenser to function as a simple soap dispenser without the signal/timing/recordkeeping functionality provided by base 70. This ability to remove the base may be desirable after a child or employee has been adequately trained in hand washing and the person wants to discontinue timing/signaling but still wants to have use of the soap dispenser itself.

Base 70 may include base bottom 71 that may be designed to sit roughly flat on a surface, such as a sink, table or a platform that is attached to a wall. Base bottom 71 may be moveably coupled with base cover 72 that moves up and down in relation to base bottom 71. Base/dispenser attachment mechanism 79 may be coupled to the top surface of base cover 72 (or alternatively coupled to the bottom surface of container 10). Attachment mechanism 79 may either permanently or detachably couple base 70 to container 10. If attachment mechanism 79 is detachable, the entire base structure (e.g., base bottom 71, base cover 72 and any internal electronics or components) may be removed from container 10. Attachment mechanism 79 may include, but is not limited to, double-sided tape, a pressure sensitive adhesive (PSA), non-permanent adhesive glues and/or gels, a Velcro™-like material and any other attachment mechanisms that allow for the soap dispenser to be coupled to the top of base cover 72.

When base 70 is detachable from container 10, the user of the soap dispenser may purchase both base 70 and the soap dispenser but swap out another soap dispenser to be used with base 70. For example, the soap dispenser may be replaced if cleaning composition 19 runs out and/or if the user does not like the design or functionality of the dispenser. To replace the soap dispenser, the user may take container 10 off base cover 72 by detaching attachment mechanism 79 and either reusing attachment mechanism 79 or using another attachment mechanism to couple a new soap dispenser to base 70. In another embodiment, an attachment mechanism may not be needed such that the new soap dispenser may be placed on the top of base cover 72 and gravity may keep the soap dispenser in place on the top surface of base cover 72. The new soap dispenser does not have to fit exactly on the footprint of base 70, so long as the top surface of base cover 72 is flat. For example, the new soap dispenser can be either smaller or larger than the footprint of base 70 or the new soap dispenser may have a different shape altogether, but the dispenser may still be placed on the flat, horizontal top surface of base cover 72.

It may also be desirable to add a weight (not expressly shown) to base bottom 71 (or perhaps base cover 72) that helps keep the center of gravity on the entire apparatus low so that it doesn't tip over easily. This anti-tipping function could also be achieved with some type of suction and/or attachment mechanism added to the bottom surface of base bottom 71 to keep base bottom 71 in contact with the surface that it is sitting upon.

Signal mechanism 51, recording mechanism 61 and power supply 21 may be located on the top surface of base bottom 71. In the illustrated embodiment, switch (or pressure sensor) 27 may be located on top of power supply 21 and below the top cover of base cover 72. The weight of container 10 may tend to push base cover 72 down onto switch 27 because base cover 72 is moveable up and down with respect to base bottom 71 and the weight of container 10 is pushing down on base cover 72. However, spring/biasing mechanism 75 may prevent base cover 72 from touching switch 27 in an unbiased position (e.g., the normal resting position for container 10 when placed on the top surface of base cover 72. Biasing mechanism 75 also may be designed to allow base cover 72 to contact switch 27 when a person presses on pipe discharge 14 to dispense cleaning composition 19.

In one embodiment, the soap dispenser (with and without the cleaning composition) may weigh between approximately one (1) and three (3) pounds and may require between approximately four (4) and five (5) pounds of pressure on discharge pipe 14 to extract cleaning composition 19. Biasing mechanism 75, therefore, may be configured to prevent base cover 72 from contacting switch 27 until a person pushes down on discharge pipe 14 to pump out cleaning composition 19. Once switch 27 is activated by a person using the soap dispenser, signal mechanism 51 and recording mechanism 61 may operate as described with respect to FIG. 2.

Figure 4:
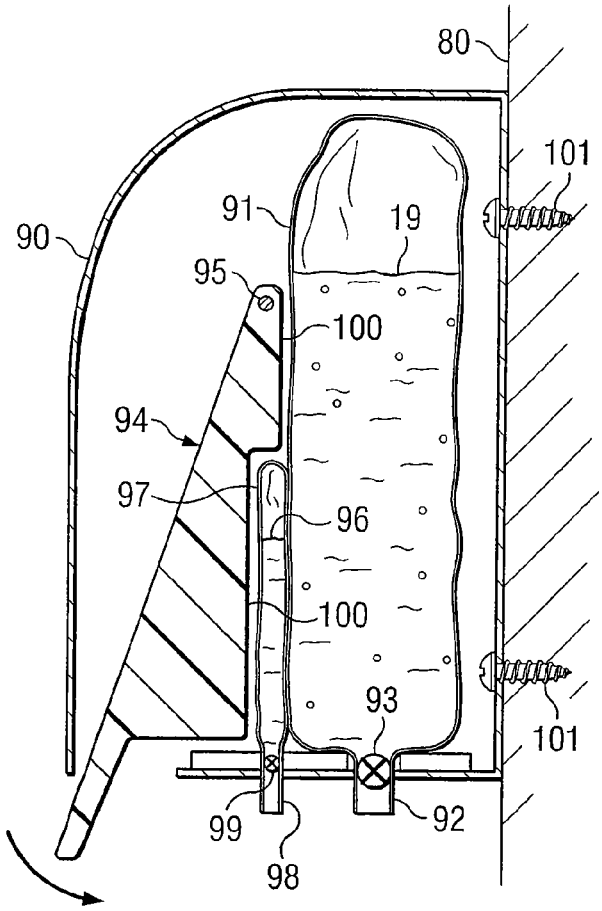
FIG. 4 illustrates a cross-sectional view of an exemplary embodiment of a commercial, wall mounted soap dispenser according to teachings of the present disclosure.

FIG. 4 is a cross-sectional view of one embodiment of a commercial, wall-mounted soap dispenser that includes a marking mechanism. In the illustrated embodiment, the soap dispenser includes cover 90 coupled to wall 100 using attachment mechanism 101. Attachment mechanism 101 may be a bolt, screw, nail, hook, pin, rivet, lug, latch, clamp or any other suitable type of fastener that allows the dispensers to be mounted on wall 80. In other embodiments, attachment mechanism 101 may be double-sided tape, a pressure sensitive adhesive (PSA), non-permanent adhesive glues and/or gels, a Velcro™-like material and any other attachment mechanisms that allow for the dispenser to be detachably mounted on wall 80. The soap dispenser further includes container 91 located within cover 90 that contains cleaning composition 19 and container 97 located within cover 90 that contains easily identifiable substance 96.

Container 91 may be an elastomer bag, thermo plastic bottle or any other container that is capable of sustaining deformation under a pressure (e.g., a pressure exerted when lever 94 is pushed toward container 91 by a user of the dispenser) without permanent loss of size or shape. Effluent channel 92 including valve 93 may be located at the bottom of container 91. In one embodiment, valve 93 may prevent cleaning composition 19 from gravity draining out of container 91 through effluent channel 92 when container 91 is not being compressed. As illustrated, the dispenser may also include container 97, which contains easily identifiable substance 96. Container 97, like container 91, may be an elastomer bag, thermo plastic bottle or any other container that is capable of sustaining deformation under a pressure without permanent loss of size or shape. Container 97 may also have effluent channel 98 that includes valve 99. Valve 99 may prevent easily identifiable substance 96 from gravity draining out of container 97 until container 97 is compressed. The use of compressible containers, effluent channels and valves in commercial dispensers are known in the art and as such various modifications may be made to the exemplary embodiment discussed herein without departing from the spirit of the teachings of the present disclosure.

In one embodiment, container 97 may be attached to (or integral with) container 91 and may be sized to hold roughly enough of easily identifiable substance 96 to run dry at approximately the same time that cleaning composition 19 is completely drained from container 91. Container 97 may be much smaller than container 91 since a much larger amount of cleaning composition 19 may be used during hand washing than the amount of easily identifiable substance 96. For example, container 97 may be between approximately fifty (50) times and two (2) to four (4) orders of magnitude smaller than container 91 such that the containers both run out of their respective substances at generally the same time. In another embodiment, container 91 may be sized such that cleaning composition 19 runs out before easily identifiable substance 96 to ensure that a mark is placed on a user's hand when the soap dispenser is used since the dispenser cannot function without cleaning composition 19. If containers 91 and 97 are attached or integral to one another, both containers 91 and 97 may be replaced when container 91 runs out of cleaning composition and/or container 97 runs out of easily identifiable substance 96. The integrated configuration may simplify maintenance of the soap dispenser such that replacing or and/or refilling easily identifiable substance 96 is no more difficult than replacing the cleaning composition in conventional dispensers.

In another embodiment, containers 91 and 97 may be independent of one another and refilling and/or replacing the substance in either one of them may not be contingent on the levels in the other container. This independent configuration may optimize the use of the substances contained in containers 91 and 97, which can increase the amount of maintenance needed for the dispenser. However, container 97 may be large enough such that refilling and/or replacing easily identifiable substance 96 would be done on an infrequent basis to minimize maintenance issues since the amount of easily identifiable substance 96 typically needed on a per use basis is veer small.

The amount of cleaning composition 19 and/or easily identifiable substance 96 may be monitored by, for example, including a transparent window in cover 90. In other embodiments, cover 90 may be transparent or the dispenser may include a sensor that notifies a user if cleaning composition 19 and/or easily identifiable substance 96 have run out. If containers 91 and 97 are integrated, the monitoring mechanism may detect the level of cleaning composition 19 contained in container 91 to indicate that containers 91 and 97 should be refilled and/or replaced. If containers 91 and 97 are separate, the dispenser may include separate monitoring mechanisms for each of cleaning composition 19 and easily identifiable substance 96.

The soap dispenser may further include lever 94 that may be pushed inward or pulled outward by a user's hand such that the motion causes lever 94 to rotate (e.g., in a counter clockwise direction, as shown in FIG. 4) around pivot point 95 that is attached to cover 90. The motion of lever 94 may exert pressure on both containers 91 and 97 such that cleaning composition 19 and easily identifiable substance 96 may be respectively dispensed through effluent channels 92 and 98. As illustrated, the shape of surface 100 that is adjacent to or in contact with containers 91 and 97 may have topography features designed so that simultaneous (or roughly simultaneous) pressure is exerted on both containers 91 and 97. The pressure exerted by lever 94 on containers 91 and 97 may result in cleaning composition 19 being forced through valve 93 and easily identifiable substance 96 being forced through valve 99.

In another embodiment, lever 94 may be used as a trigger for an electronic or pneumatic mechanism to force both cleaning composition 19 and easily identifiable substance 96 respectively out of containers 91 and 97 and on to a person's hand. In this example, containers 91 and 97 may not be compressible but may instead be a cartridge or some other type of container typically used with inks or dyes.

The size and types of effluent channels and valves on both containers 91 and 97 may be designed to spray or release the correct amount of cleaning composition 19 and/or easily identifiable substance 96. Typically, because the amount of easily identifiable substance 96 needed to mark a person's hand in a highly visible way is small, a much greater amount of cleaning composition 19 is needed per use than easily identifiable substance 96. Effluent channel 98 and valve 99, therefore, may be smaller than effluent channel 92 and valve 93. In one embodiment, effluent channel 92 of container 91 and effluent channel 98 of container 97 may be placed in close proximity with each other in order to allow both cleaning composition 19 and easily identifiable substance 96 to be placed substantially concurrently on a user's hand. However, it also may be possible that easily identifiable substance 96 is placed on the back of a user's hand while cleaning composition 19 is placed on the front (e.g., the palm) of the hand.

In another embodiment, container 97 may include multiple effluent channels or a nozzle with multiple orifices to dispense easily identifiable substance 96 onto multiple areas of a user's hand. In a further embodiment, effluent channel 92 to dispense cleaning composition 19 may be surrounded by effluent channel 98 such that easily identifiable substance 96 is dispensed onto a user's hand in a ring around cleaning composition 19. Placement of the multiple marks could be designed to facilitate optimum hand washing since the multiple marks may require a more thorough washing of the hand. As described above, this forces the user to do a good job of washing their hand or the resulting mark(s) on their hand will be obvious.

Figure 5:
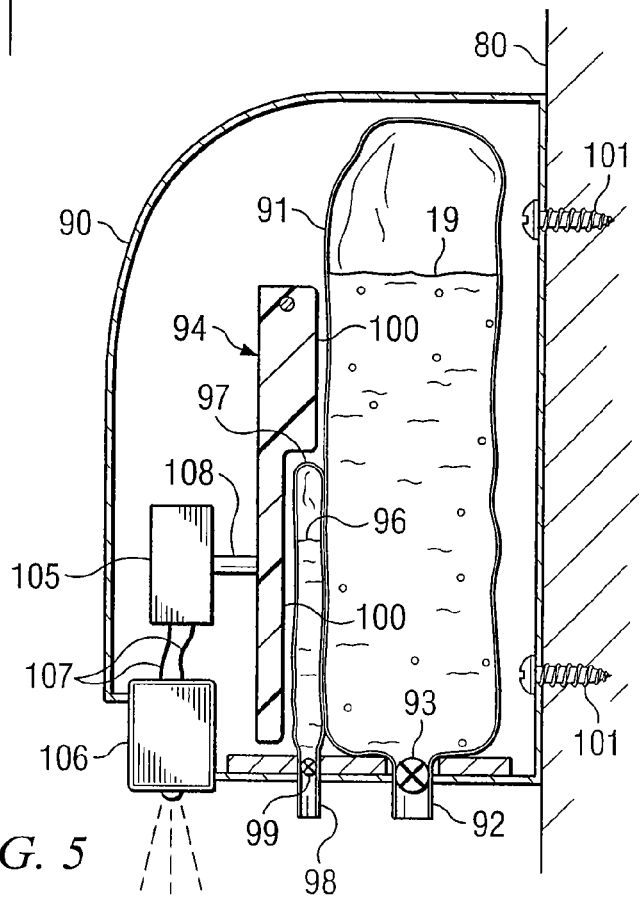
FIG. 5 illustrates a cross-sectional view of another exemplary embodiment of a commercial, wall mounted soap dispenser that uses a sensor to detect when the soap dispenser is being used according to teachings of the present disclosure.

FIG. 5 is a cross-sectional view of another embodiment of a commercial, wall-mounted, hand marking soap dispenser that includes sensor 106 for detecting use of the dispenser. In one embodiment, the dispenser may be a touch free soap dispenser such as the "One Shot" dispenser designed and manufactured by Technical Concepts. As illustrated, the dispenser may include sensor 106 that detects the presence of a user's hand located under the dispenser. Once sensor 106 detects a user's hand, it may dispense both cleaning composition 19 and easily identifiable substance 96 onto the user's hand. Sensor 106 may be any type of active or passive sensor that detects the presence of a user's hand under the dispenser. For example, sensor 106 may be an infrared sensor as described in U.S. Pat. No. 5,492,247.

Both of cleaning composition 19 and easily identifiable substance 96 may be dispensed onto the user's hand by a dispensing mechanism that includes biasing mechanism 105 and drive 108. In one embodiment, sensor 106 may communicate through electronic connection 107 (e.g., wires) with biasing mechanism 105 (e.g., a motor), which uses drive 108 to push surface 100 of lever 94 into containers 91 and 97. Similar to the mechanism described with respect to FIG. 4, the resulting pressure on containers 91 and 97 forces cleaning composition 19 and easily identifiable substance 96 through valves 93 and 99 respectively and onto the user's hand. Although a specific drive mechanism is illustrated, the drive mechanism may be mechanical, electronic, pneumatic, or electronic/pneumatic, and include components such as pumps, motors, sprayers, and/or compressors such that cleaning composition 19 and easily identifiable substance 96 may be dispensed on to a user's hand when sensor 106 detects the presence of the hand under the dispenser. One such suitable drive mechanism is a liquid pump mechanism as set forth in U.S. Pat. No. 6,607,103. The use of drive mechanisms in commercial dispensers are known in the art and as such various modifications may be made to the exemplary embodiment discussed herein without departing from the spirit of the teachings of the present disclosure.

Figure 6:
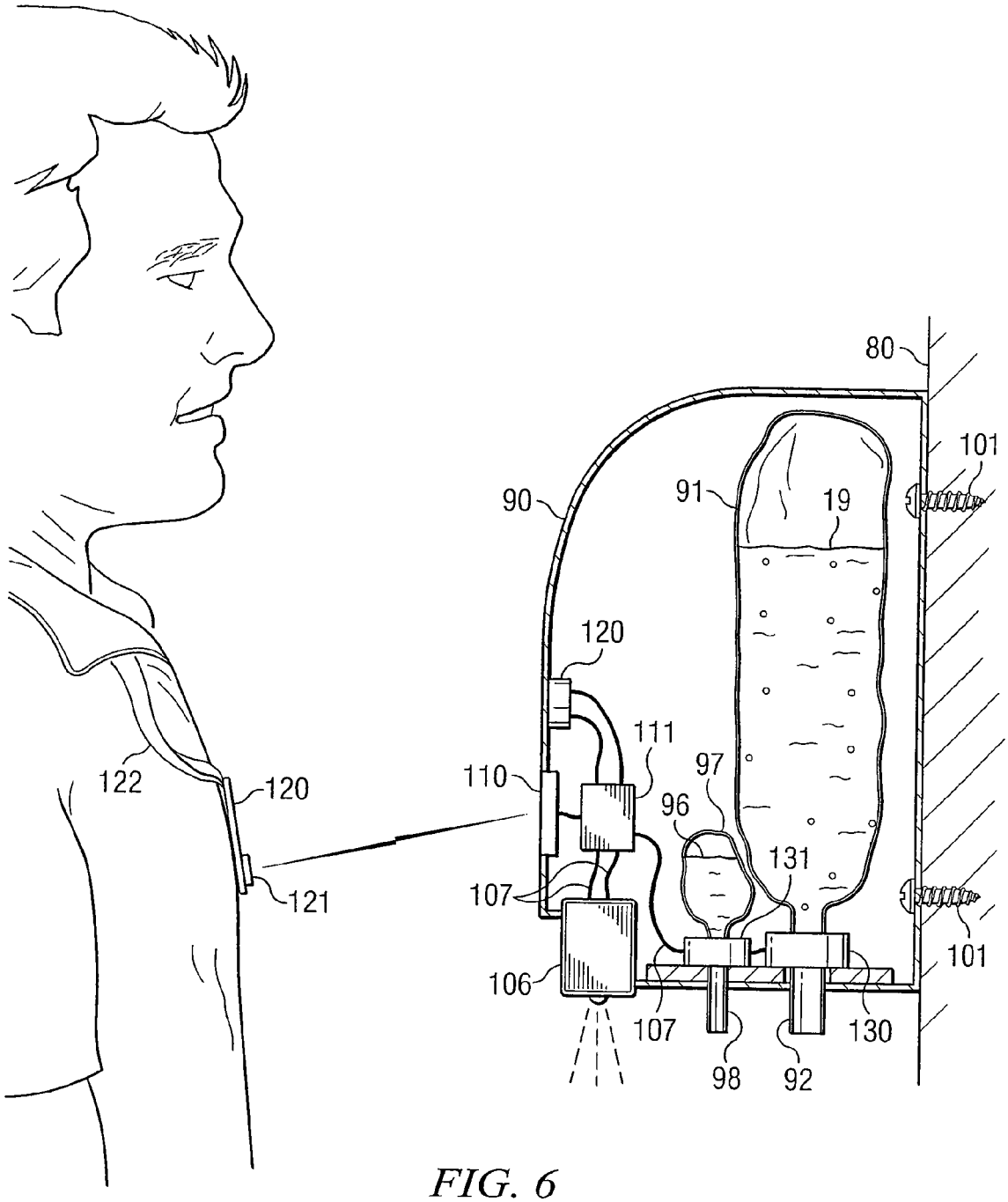
FIG. 6 illustrates a cross-sectional view of a further exemplary embodiment of a commercial, wall mounted soap dispenser that includes a sensor used to discriminate between different classes of users according to teachings of the present disclosure.

FIG. 6 is a cross-sectional view of another embodiment of a commercial, wall-mounted, hand marking soap dispenser that has the ability to distinguish between different users. In certain environments, a marking soap dispenser may be used to mark the hand of certain users of a dispenser but not others. For example, a marking soap dispenser may be used in a restaurant rest room where the establishment may not want to mark it's customers' hands but does want to mark it's employees to assure effective employee hand washing. In one embodiment, the restaurant restroom may have two separate soap dispensers. One soap dispenser may include a marking mechanism and be labeled "Employee Soap Dispenser" and the other can be a conventional dispenser that does not mark a person's hand. In another embodiment, rather than using two dispensers, the dispenser may have a sensor that distinguishes between two or more classes of users. For example, the dispenser may recognize that an employee is using the dispenser and dispense both cleaning composition 19 and easily identifiable substance 96 on to the user's hand. If, on the other hand, the dispenser is used by a non-employee (e.g., a customer) the dispenser may only dispenses cleaning composition 19 onto the user's hand.

As illustrated in FIG. 6, classes of users may be distinguished by using sensor 110, which may be designed to detect whether a user is wearing, is attached to or is in proximity to some distinguishing characteristic such as electronically distinguishable device 121. For example, sensor 110 may be able to detect whether electronically distinguishable device 121 is within some desired distance (e.g., between approximately zero to five feet) from the soap dispenser. In this example, all employees of the restaurant may have electronically distinguishable device 121 (e.g., a RFID device) embedded in their name tags, wrist bands, clothing or even in sub-dermal manner. As shown, name tag 120 may be attached to a user with band 122 (or alternatively pinned on clothing) and may include electronically distinguishable device 121. In another embodiment, sensor 110 may be a biometric sensor (not expressly shown) that distinguishes between users by using fingerprints, irises or other biometric features (e.g. see U.S. Pat. Nos. 6,206,238 and 5,960,991).

The soap dispenser, as illustrated in FIG. 6, may also include processor 111 that is connected to both sensor 106 (e.g., the hand detecting sensor) and second sensor 110 (e.g., the class of user detecting sensor) by connection 107 (e.g., wires). Processor 111 may be microprocessor, a microcontroller, a digital signal processor (DSP), an application specific integrated circuit (ASIC), a field programmable gate array (FPGA) or any other digital or analog circuitry configured to execute processing instructions. Once sensor 106 detects a hand (or some other item) underneath the dispenser, sensor 106 may communicate a signal to processor 111.

After receiving the signal from sensor 106, processor 111 may determine if sensor 110 has detected the presence of electronically distinguishable device 121. If sensor 110 has detected electronically distinguishable device 121, sensor 110 communicates a signal to processor 111 indicating the presence of electronically distinguishable device 121 such that processor 111 directs soap dispensing mechanism 130 to dispense cleaning composition 19 onto the user's hand and substance dispensing mechanism 131 to dispense easily identifiable substance 96 on the user's hand. In one embodiment, cleaning composition 19 and easily identifiable substance 96 may be substantially simultaneously dispensed onto the user's hand. If, however, sensor 110 does not detect the presence of electronically distinguishable device 121 when sensor 106 detects the user's hand under the dispenser, processor 111 may only direct soap dispensing mechanism 130 to dispenses the desired amount of cleaning composition 19. Therefore, the soap dispenser marks the desired users (e.g., employees) with easily identifiable substance 96 when they wash their hands but does not mark others (e.g., non-employees).

The soap dispenser may further include power mechanism 120 (e.g., a battery) that provides power to the various electronic components. Power mechanism 120 may be internal or external to the dispenser such that the electronic components (e.g., sensors 106 and 110, microprocessor 111 and dispensing mechanisms 130 and 131) receive power needed to operate. If power mechanism 120 is a battery, the dispenser may include a life indicator associated with power mechanism 120 that provides information about the amount of charge remaining in the battery. In another embodiment, a monitoring mechanism (e.g., a sensor) may be associated with container 91 and/or container 97 to respectively show the amount of cleaning composition 19 and/or easily identifiable substance 96. This monitoring mechanism may be used to determine when cleaning composition 19 and/or easily identifiable substance 96 should be replaced.

As illustrated in FIG. 6, the method of dispensing cleaning composition 19 and/or easily identifiable substance 96 may not be accomplished by exerting a pressure on container 91 and 97 as shown in FIGS. 4 and 5. Instead, cleaning composition 19 and easily identifiable substance 96 may be dispensed using respective dispensing mechanisms 130 and 131 that may receive signals from processor 111 through wires 107. Dispensing mechanisms 130 and 131 use the communicated signal to respectively release cleaning composition 19 through effluent channel 92 and easily identifiable substance 96 through effluent channel 98 such that the substances are placed on a user's hand. However, in another embodiment, cleaning composition 19 and easily identifiable substance 96 may be dispensed using a compression mechanism (as illustrated in FIGS. 4 and 5) and the mechanical lever used to compress containers 91 and 97 may trigger processor 111 and dispensing mechanism 131. Processor 111 may then be used to determine if electronically distinguishable device 121 was detected by sensor 110 such that processor 111 directs dispensing mechanism 131 to dispense substance 96 as cleaning composition 19 is compressed out of container 91 if processor 111 receives a signal from sensor 110.

Although specific mechanisms for dispensing cleaning composition 19 and easily identifiable substance 96 have been described, there are many ways of dispensing cleaning composition 19 and/or easily identifiable substance 96 from their respective containers. These mechanisms may include: motors, pumps, sprayers, printers, valves, compressors, jets, fans, and any combinations thereof. Additionally, the mechanism used to dispense cleaning composition 19 may be different from the mechanism to dispense easily identifiable substance 96. The use of dispensing mechanisms in commercial dispensers are known in the art and as such various modifications may be made to the exemplary embodiment discussed herein without departing from the spirit of the teachings of the present disclosure.

In other embodiments, the signal, timing and/or record keeping features described with reference to and illustrated in FIGS. 2 and 3 may also be included (but are not expressly shown) in the commercial dispensers illustrated in FIGS. 4 through 6. The record keeping functions may also be used effectively in conjunction with electronically distinguishable device 121 (or biometrics) in order to track use of the soap dispenser by certain individuals. For example, with RFID devices designed to distinguish between particular items/people (e.g., an electronic badge as described in U.S. Pat. No. 5,610,589, which is incorporated herein by reference), the dispensers illustrated in FIGS. 1 through 6 could keep records and show trends concerning specific use of the dispenser by particular users (e.g., employees and/or doctors and nurses). The information recorded may include, but is not limited to, the identity of the user, the time of use by the identified user, the frequency of use by the identified user during a certain period of time (e.g., the user's shift) and the location of the dispenser used by the identified user.

One example of a commercially available system that monitors hand washing using employee badges and reporting software is the iHygiene System manufactured by Woodward Laboratories. The iHygiene System is a touch-free soap dispenser that includes a wireless monitoring system to communicate with wireless communication enabled badges. The system stores time and date stamped hand washing hygiene compliance statistics that allows hygiene compliance to be tracked by site, shift, time of use, personnel, etc. Although a specific monitoring mechanism has been described, the use of monitoring mechanisms in commercial dispensers are known in the art and as such various modifications may be made to the exemplary embodiment discussed herein without departing from the spirit of the teachings of the present disclosure.

The notion of "dirtying" one's hands as a soap dispenser is used in order to subsequently get the hands more effectively clean may be counter-intuitive, but it results in especially clean hands if the easily identifiable substance, marking mechanism and signal mechanism are well chosen. Also the idea of signaling use of the dispenser to coerce use of the dispenser is helpful in increasing frequency of hand washing.

Although the present disclosure has been described in detail, it should be understood that various changes, substitutions, and alterations can be made without departing from the spirit and scope of the disclosure as defined by the appended claims.

What is claimed is:

1. A method for helping to assure washing of a person's hands using a soap dispenser operable to contain a cleaning composition, comprising:

marking a hand of a user with an easily identifiable substance through contact between the hand and the soap dispenser activation mechanism, that can be washed off with the cleaning composition when the soap dispenser is utilized; and providing a signal that indicates the user has utilized the soap dispenser.

2. The method of claim 1, wherein the signal comprises at least one of an audible, visual, olfactory, tactile and kinetic signal.

3. The method of claim 1, wherein the signal comprises a timer operable to inform the user of a desired duration for hand washing.

4. The method of claim 1, further comprising activating a delayed signal for a predetermined amount of time after the soap dispenser has been utilized.

5. The method of claim 1, wherein the signal is designed to coerce the user to utilize the soap dispenser.

6. The method of claim 1, further comprising recording information about the utilization of the soap dispenser.

7. The method of claim 6, wherein the information recorded is selected from the group consisting of time of use, identity of the user, frequency of use, location of the soap dispenser, and combinations thereof.

8. The method of claim 1, wherein the marking mechanism comprises: an absorbent pad having a first thickness; and a compressible protective perimeter surrounding the absorbent pad operable to bring the hand of the user in contact with the absorbent pad when the activation mechanism is utilized, the compressible protective perimeter having a second thickness greater than the first thickness of the absorbent pad.

9. The method of claim 1, wherein the marking mechanism comprises a dispensing mechanism to dispense the easily identifiable substance on to the hand of the user approximately concurrent with the dispensing of the cleaning composition.

10. An apparatus for helping to assure washing of a person's hands, comprising:

a soap dispenser for dispensing a cleaning solution;

a marking mechanism for dispensing an easily identifiable substance coupled to the soap dispenser to mark a hand of a user of the soap dispenser, whereby better hand washing is encouraged through sufficient exposure to the cleaning solution to remove the easily identifiable substance; and a signal mechanism coupled to the soap dispenser that indicates the user has utilized the soap dispenser.

11. The apparatus of claim 10, wherein the signal mechanism coupled to the soap dispenser coerces the user to utilize the soap dispenser.

12. The apparatus of claim 10, further comprising a recording mechanism coupled to the soap dispenser to collect information about utilization of the soap dispenser.

13. The apparatus of claim 10, wherein the marking mechanism comprises: an absorbent pad including the easily identifiable substance, the absorbent pad having a first thickness; and a compressible protective perimeter surrounding the absorbent pad, the compressible perimeter having a second thickness greater than the first thickness of the absorbent pad.

14. The apparatus of claim 10, wherein the marking mechanism comprises a dispensing mechanism to dispense an easily identifiable substance on to the hand of the user approximately concurrent with dispensing of a cleaning composition.

15. The apparatus of claim 14, wherein the dispensing of the easily identifiable substance is selected from the group consisting of spraying, micro-dotting, gravity dropping, printing, misting and squirting.

16. A device for assuring washing of a person's hands comprising:

a hand marking mechanism, integrated with a disinfectant dispensing device, configured to dispense a marking substance, said dispensed marking substance being third-party identifiable until diminished by sufficiently prolonged exposure to disinfectant; and the disinfectant dispensing device having a signaling mechanism, said signaling mechanism configured to produce a third-party perceivable signal, whereby the disinfectant device is capable of being configured to perform each of: signaling the desired duration of hand washing, signaling usage of the disinfectant device, and signaling to coerce a user to use the disinfectant dispensing device.

17. The device of claim 16, further comprising a recording device for recording information about the utilization of the soap dispenser.

18. The device of claim 17, wherein the information recorded is selected from the group consisting of time of use, identity of the user, frequency of use, location of the soap dispenser, and combinations thereof.

* * * * *